US007987647B2

(12) United States Patent
Rymell et al.

(10) Patent No.: US 7,987,647 B2
(45) Date of Patent: Aug. 2, 2011

(54) RE-ROOFING SYSTEM AND A METHOD OF INSTALLATION

(76) Inventors: Robert John Rymell, Innisfil (CA); Angelo Parravano, Aurora (CA)

( * ) Notice: Subject to any disclaimer, the term of this patent is extended or adjusted under 35 U.S.C. 154(b) by 409 days.

(21) Appl. No.: 11/542,641

(22) Filed: Oct. 4, 2006

(65) Prior Publication Data

US 2008/0083183 A1 Apr. 10, 2008

(51) Int. Cl.
*E04B 9/00* (2006.01)
*E04C 2/32* (2006.01)

(52) U.S. Cl. ..... 52/506.06; 52/408; 52/783.11; 52/798.1

(58) Field of Classification Search ..... 52/90.2, 52/550, 408, 410, 514, 745.06, 473, 537, 52/783.11, 783.14, 783.18, 798.1, 479, 480, 52/506.01, 506.06
See application file for complete search history.

(56) References Cited

U.S. PATENT DOCUMENTS

| | | | | | |
|---|---|---|---|---|---|
| 1,000,758 | A | * | 8/1911 | Rude | 428/589 |
| 3,474,583 | A | * | 10/1969 | Manias | 52/302.7 |
| 4,282,050 | A | * | 8/1981 | Thiis-Evensen | 156/71 |
| 4,494,343 | A | * | 1/1985 | Berry et al. | 52/309.11 |
| 4,620,397 | A | * | 11/1986 | Simpson et al. | 52/66 |
| 4,691,491 | A | * | 9/1987 | Lilley | 52/22 |
| 4,791,770 | A | * | 12/1988 | Bell et al. | 52/543 |
| 5,005,323 | A | * | 4/1991 | Simpson et al. | 52/90.2 |
| 5,088,259 | A | * | 2/1992 | Myers | 52/410 |
| 5,367,848 | A | * | 11/1994 | McConnohie | 52/336 |
| 5,511,354 | A | * | 4/1996 | Eidson | 52/544 |
| 5,600,929 | A | * | 2/1997 | Morris | 52/309.8 |
| 5,875,592 | A | * | 3/1999 | Allman et al. | 52/90.2 |
| 5,911,663 | A | * | 6/1999 | Eidson | 52/520 |
| 6,004,645 | A | * | 12/1999 | Hubbard | 428/57 |
| 6,108,993 | A | * | 8/2000 | Hageman | 52/408 |
| 6,141,932 | A | * | 11/2000 | Tarrant | 52/514 |
| 6,415,581 | B1 | * | 7/2002 | Shipman et al. | 52/798.1 |
| 7,051,489 | B1 | * | 5/2006 | Swiszcz et al. | 52/783.18 |

(Continued)

FOREIGN PATENT DOCUMENTS

| | | | |
|---|---|---|---|
| CA | 2021715 | | 1/2000 |
| GB | 2400868 | A * | 10/2004 |

OTHER PUBLICATIONS

American National Standard Standard Field Test Procedure For Determining The Withdrawal Resistance Of Roofing Fasteners, ANSI/SPRI FX-1, May 2, 2001.

(Continued)

*Primary Examiner* — Robert J Canfield
*Assistant Examiner* — Brent W Herring
(74) *Attorney, Agent, or Firm* — Lynn C. Schumacher; Hill & Schumacher

(57) ABSTRACT

The present invention relates to a roof system for installation on an existing roof. The existing roof has a plurality of open web steel joists with an existing metal deck thereon. The roof system includes a plurality of deck straps, a roof deck and roofing and insulation. The plurality of deck straps are attached to the open web steel joist through the existing metal deck. The deck straps have a plurality of alternating lower portions and upper portions. The lower portions are attached to the open web steel joist. The upper portions extend upwardly of the existing metal deck. The roof deck is attached to the upper portions of the continuous deck strap. The roofing and insulation is attached to the roof deck.

8 Claims, 9 Drawing Sheets

U.S. PATENT DOCUMENTS

| | | | | |
|---|---|---|---|---|
| 7,174,686 | B1 * | 2/2007 | Legband | 52/471 |
| 2001/0018816 | A1 * | 9/2001 | Hoepker et al. | 52/783.17 |
| 2006/0096212 | A1 * | 5/2006 | Panasik | 52/408 |
| 2006/0207204 | A1 * | 9/2006 | Wasitis et al. | 52/410 |
| 2008/0163573 | A1 * | 7/2008 | Wendelburg et al. | 52/262 |
| 2009/0000246 | A1 * | 1/2009 | Chang | 52/783.11 |

OTHER PUBLICATIONS

Professional Roofing Magazine, The rise of retrofit metal, Retrofit metal roof systems are part of a changing market, Boozer et al, Sep. 2002, 10 pages.

Roofing Specs, AIA's updated Masterspec document contains important reroofing information that will help specifiers, Smith, Professional Roofing, Jul. 2001, p. 30-34.

New building code offers unified standards, Graham, Professional Roofing magazine, Mar. 2000, 5 pages.

Working With Metal Roofing? Beef It Up With Densdeck Roof Board, Schneider, Apr. 2004, 2 pages, Techtalk by G-P Gypsum.

One page article, Acute Attention to Detail, MR-24 roof clips, no date.

Performance of Fasteners, Hasan et al, NRCA/NBS 8th Conference on Roofing Technology, Apr. 1987, p. 35-40.

* cited by examiner

RE-ROOFING SYSTEM AND A METHOD OF INSTALLATION

FIELD OF THE INVENTION

This invention relates to steel roof decks and in particular to replacement steel roof decks.

BACKGROUND OF THE INVENTION

The use of steel roof decks on flat or low slope roofing is intended to perform four primary functions, namely distribution of loads such as snow, rain and wind, diaphragm action for structural purposes, a support element for the waterproofing and insulating components and fire protection for those waterproofing elements.

However, should there be a compromise of the waterproofing, deterioration of the steel occurs either through leaching of corrosive materials or simple rusting. Whether the decking is corrosion resistant coated (e.g. galvanized or painted) or not only affects the time for occurrence, once the decking if corroded its primary functions are compromised and therefore must be corrected.

To date the means of correcting the situations is to either remove the damaged decking and install new decking in its place or place new decking directly over the damaged decking. This also entails a varying degree of removal of the waterproofing and insulation layers. Each of those means has problems.

Removing of the decking requires restricted access to the building areas directly below the roof for safety reasons. There is also a great deal of debris and potential fire hazards created in such removal and replacement. Business costs are substantial. Additionally any services located on the underside of the deck must be disconnected and/or relocated. Re-roof production time is substantially increased, thereby resulting in higher contract costs as well as high business loss costs.

If, as a solution, new decking is placed directly over the corroded deck then the continuation of the corrosion or rust into the new decking will occur. The time of occurrence is dependent on the type and quality of protective coating or paint applied between the new and existing decking.

Accordingly it would be advantageous to provide a re-roofing system that can be installed without completely removing the existing roofing system.

SUMMARY OF THE INVENTION

The present invention relates to a roof system for installation on an existing roof. The existing roof has a plurality of open web steel joists with an existing metal deck thereon. The roof system includes a plurality of deck straps, a roof deck and roofing and insulation. The plurality of deck straps are attached to the open web steel joist through the existing metal deck. The deck straps have a plurality of alternating lower portions and upper portions. The lower portions are attached to the open web steel joist. The upper portions extend upwardly of the existing metal deck. The roof deck is attached to the upper portions of the continuous deck strap. The roofing and insulation is attached to the roof deck.

In another aspect of the invention there is a method of re-roofing a roof. The existing roof has a plurality of open web steel joists with an existing metal deck and existing roofing and insulation thereon. The method of re-roofing includes the steps of: removing at least a portion of the existing roofing and insulation over the existing open web steel joists; attaching a plurality of deck straps to the open web steel joist through the existing metal deck; attaching a roof deck to the upper portions of the continuous deck strap; and attaching a roof and insulation to the roof deck. The deck strap has a plurality of alternating lower portions and upper portions. The lower portions are attached to the open web steel joist and the upper portions extend upwardly of the existing metal deck.

Further features of the invention will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE INVENTION

The steps of constructing the roof system of the present invention are shown in FIGS. 1 to 5.

Figure 1:
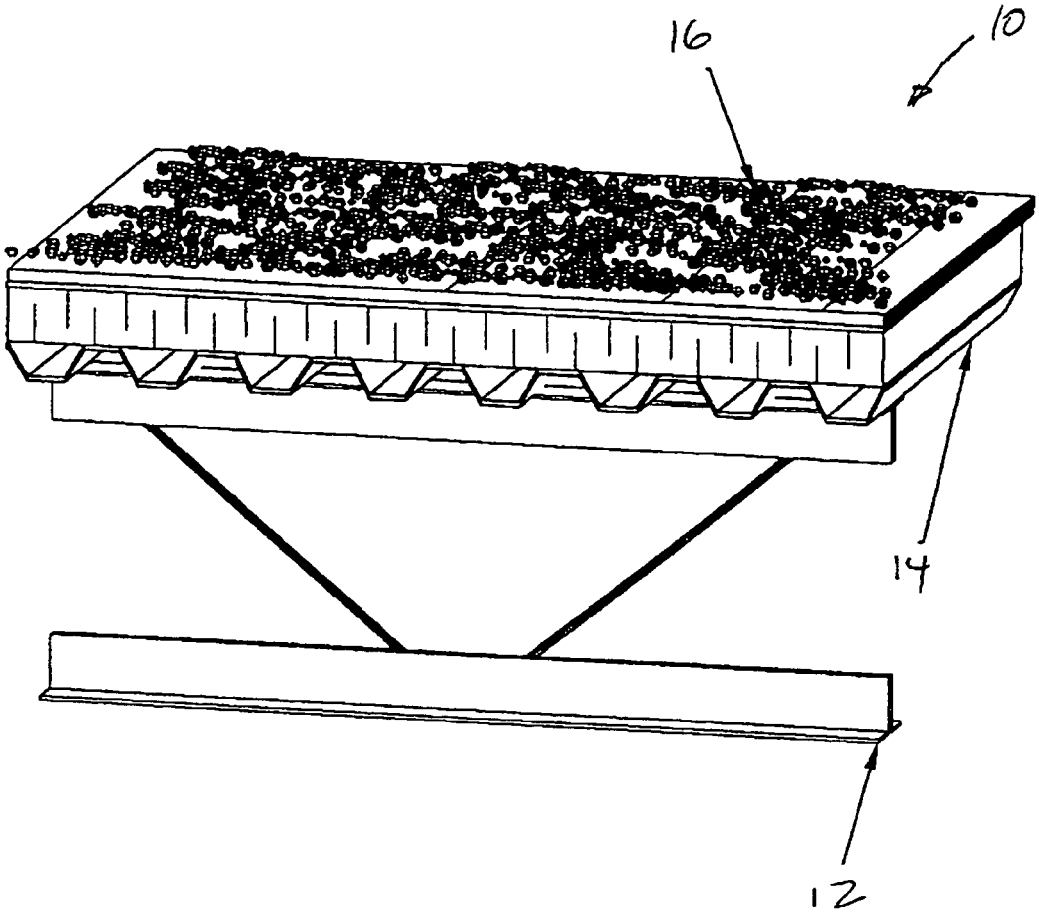
FIG. 1 is a perspective view of an existing roof prior to being re-roofed with the roof system of the present invention.

FIG. 1 shows the existing roof system generally at 10. The existing roof system 10 includes a plurality of open web steel joists 12, an existing metal deck 14 and existing roofing and insulation 16.

Figure 2:
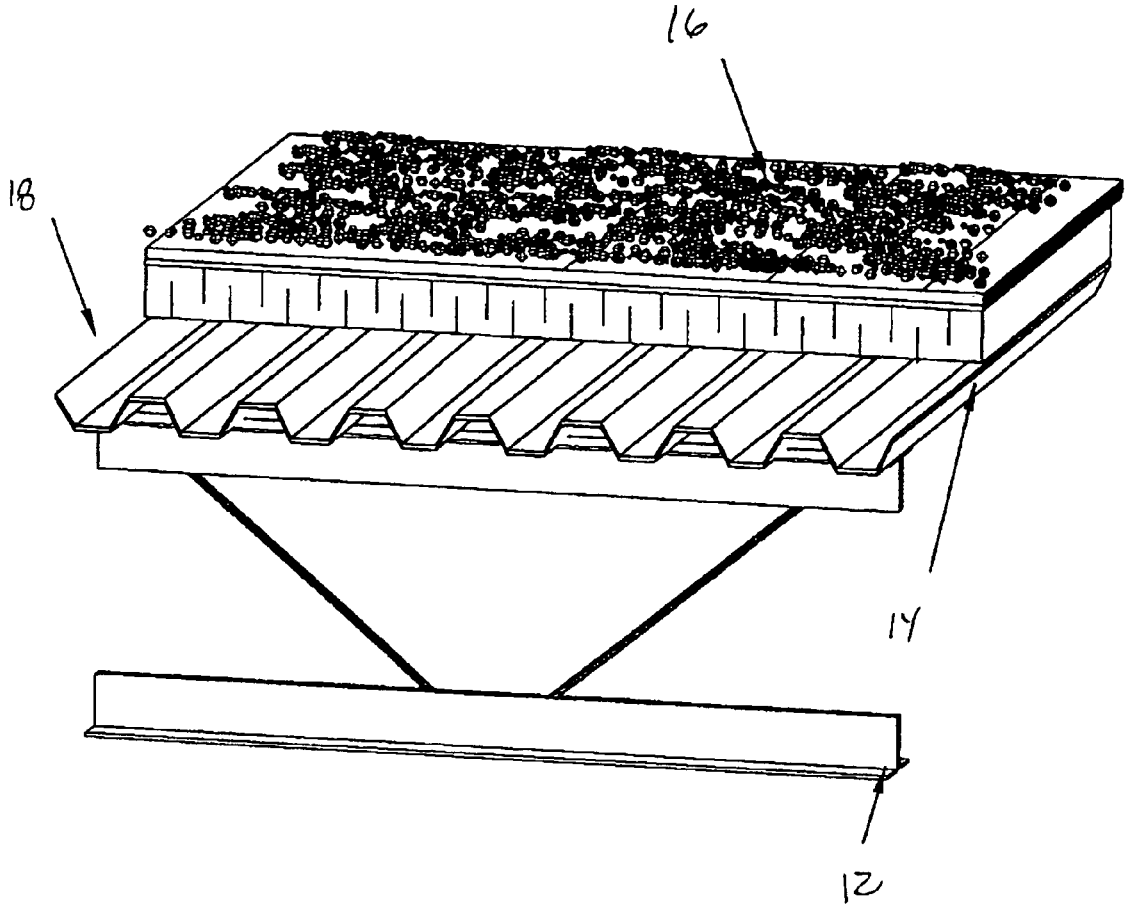
FIG. 2 is a perspective view of the existing roof with a strip of the existing roofing and insulation being removed.

The first step of re-roofing the existing roof system is to remove a strip 18 of the existing roof and insulation 16 over the open web steel joist 12 as shown in FIG. 2. A plurality of strips 18 will be removed over the roof of the building.

Figure 3:
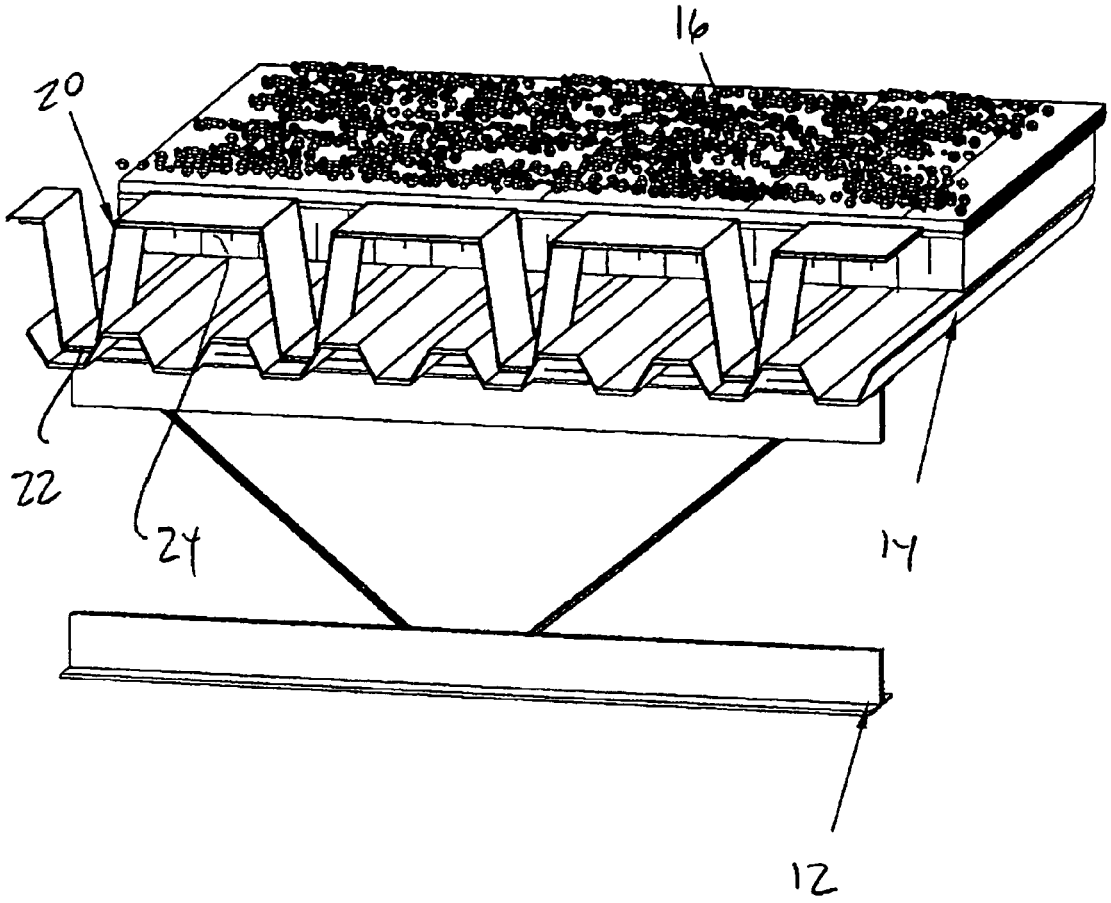
FIG. 3 is a perspective view of the roof with a continuous deck strap attached to the existing open web steel joist where the strip of the existing roofing and insulation was removed.

The next step is to fasten a new deck strap 20 over the open web steel joist 12 as shown in FIG. 3. The deck strap 20 has a plurality of alternating lower portions 22 and upper portions 24. The lower portions 22 are attached to the open web steel joist 12 through the existing metal deck 14. The upper portions 24 extend upwardly of the existing metal deck 14 and the existing roofing and insulation 16. Preferably the deck straps 20 are continuous deck straps that extend from one side of the roof to the other.

Figure 4:
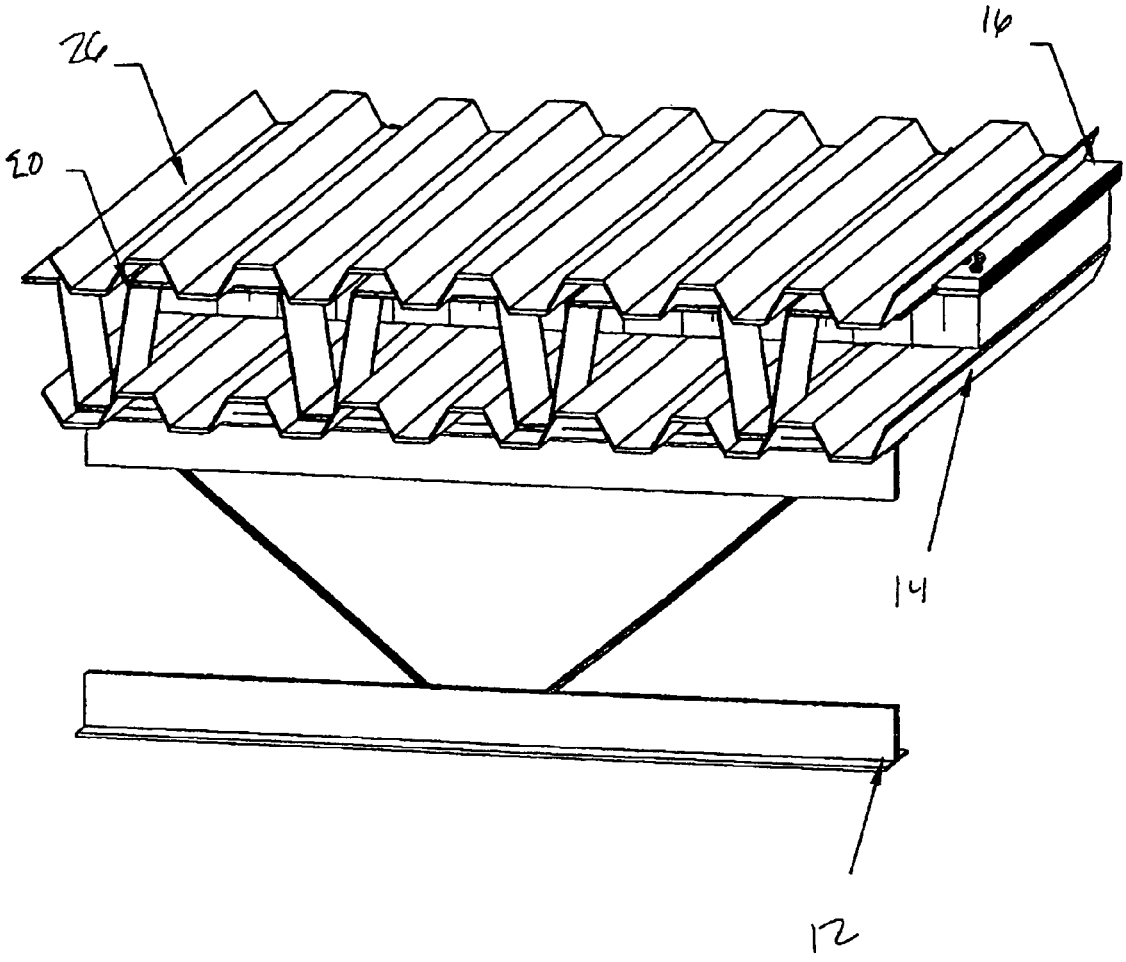
FIG. 4 is a perspective view of the roof with a new roof deck attached to the continuous deck strap over the remaining existing roof.
Figure 5:
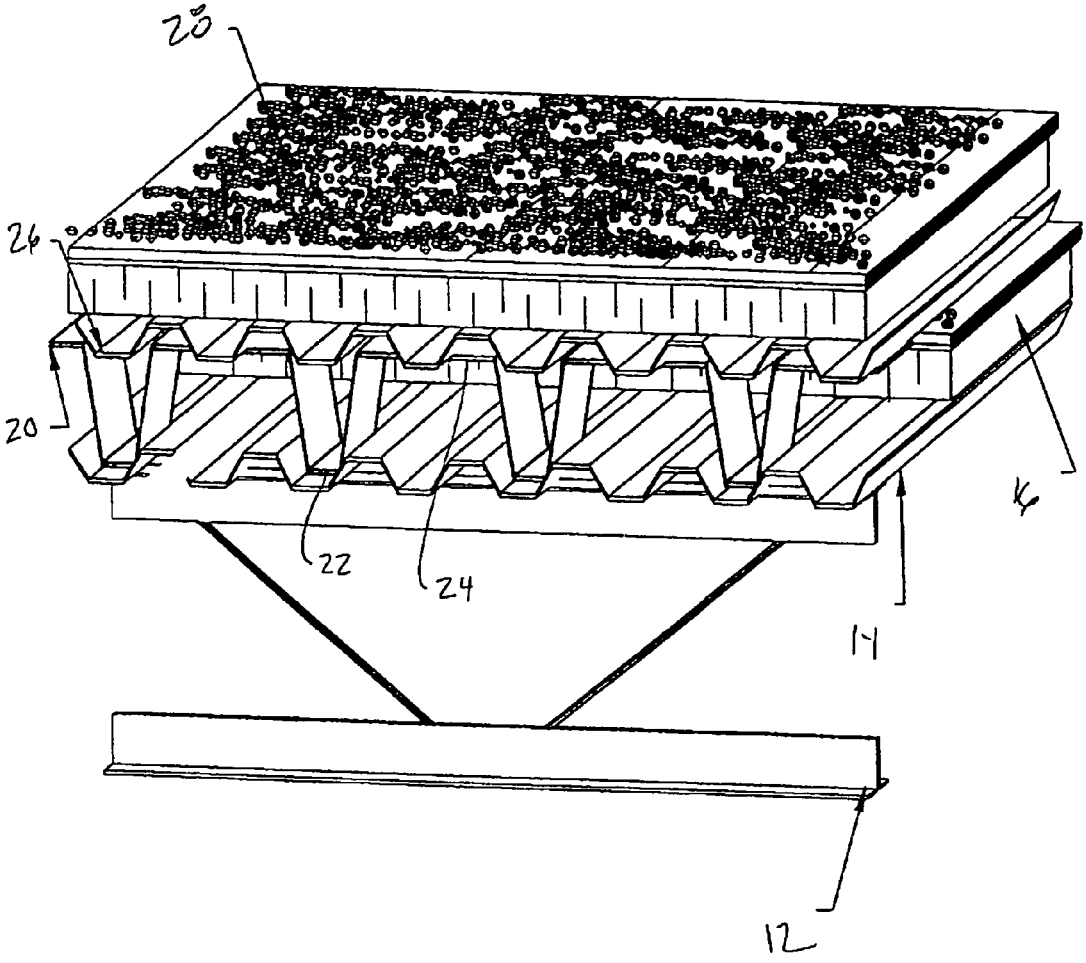
FIG. 5 is a perspective view of the roof with new roofing and insulation installed on the new roof deck.
Figure 6:
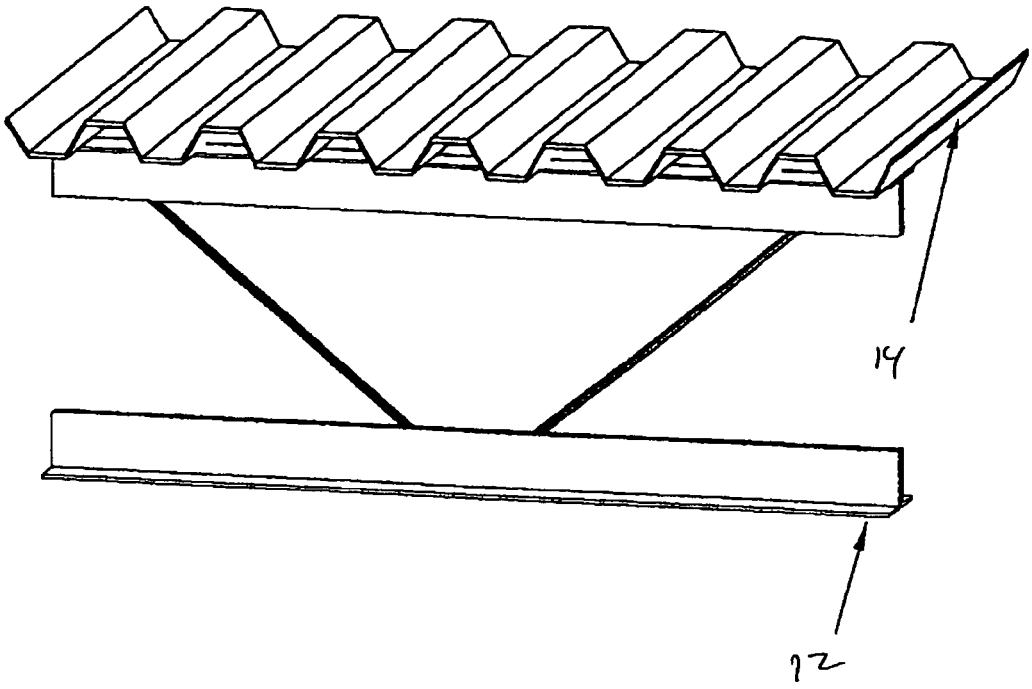
FIG. 6 is a perspective view of the existing roof similar to that shown in FIG. 2 but with all of the existing roofing and insulation removed.
Figure 7:
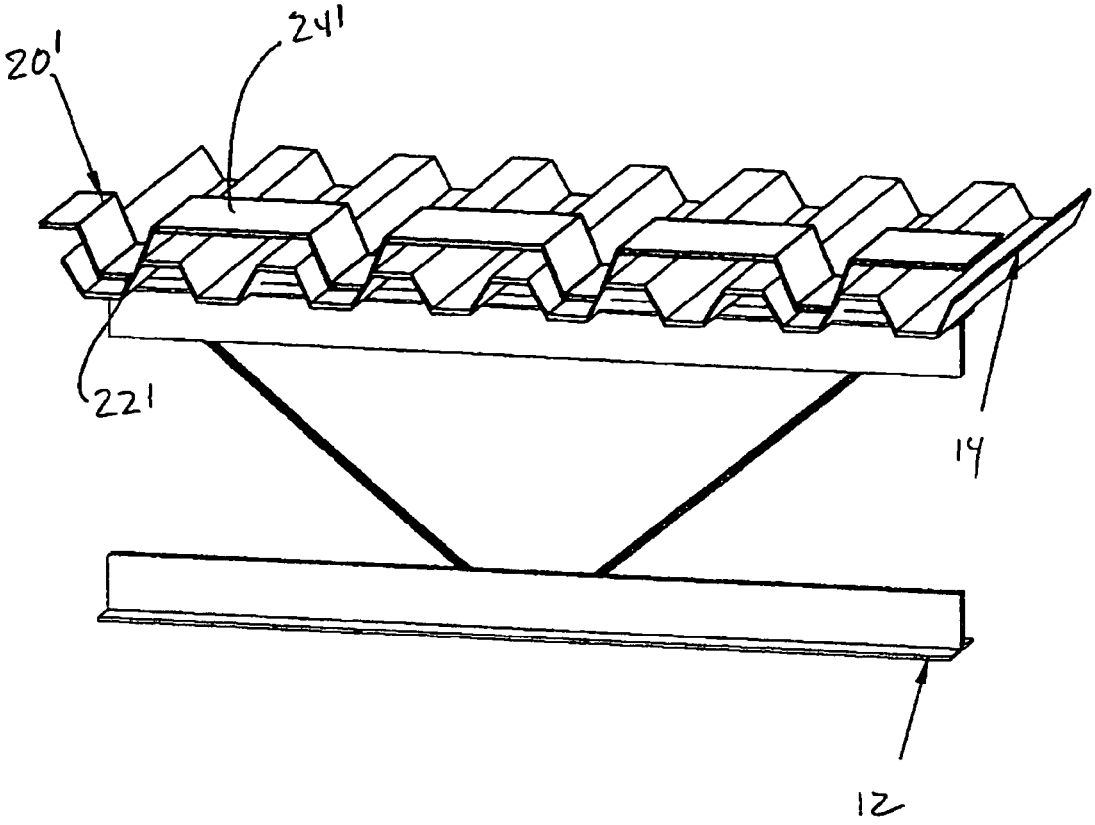
FIG. 7 is a perspective view of the roof of FIG. 6 with a continuous deck strap attached to the existing open web steel joist.
Figure 8:
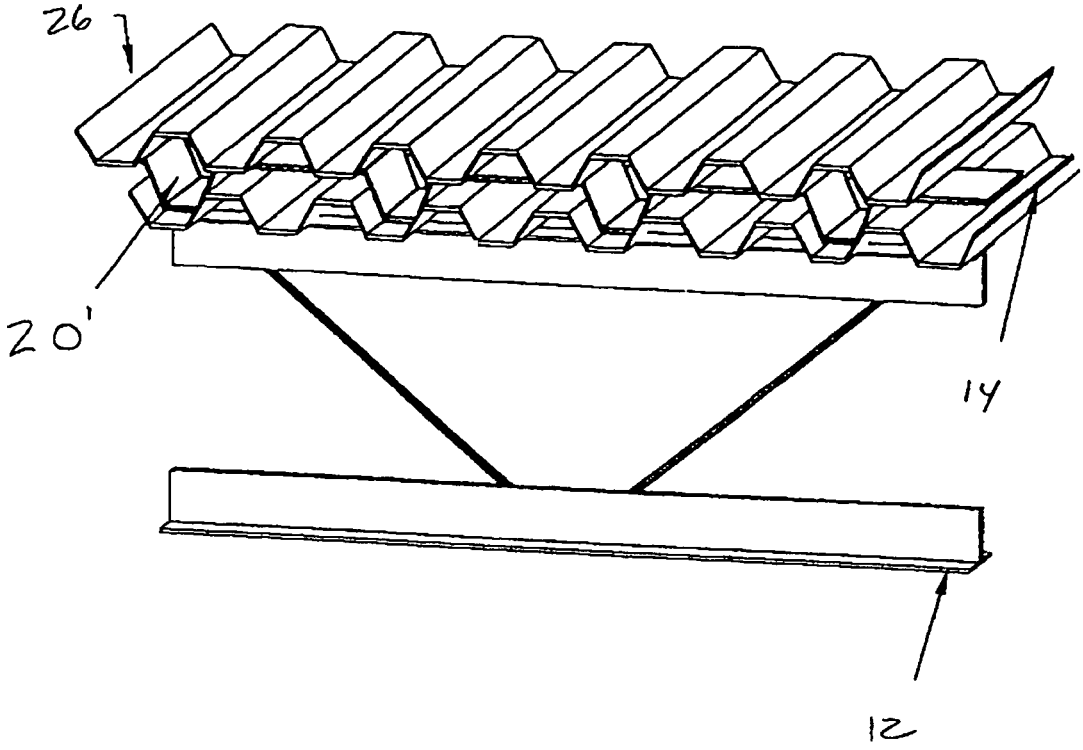
FIG. 8 is a perspective view of the roof of FIGS. 6 and 7 with a new roof deck attached to the continuous deck strap.
Figure 9:
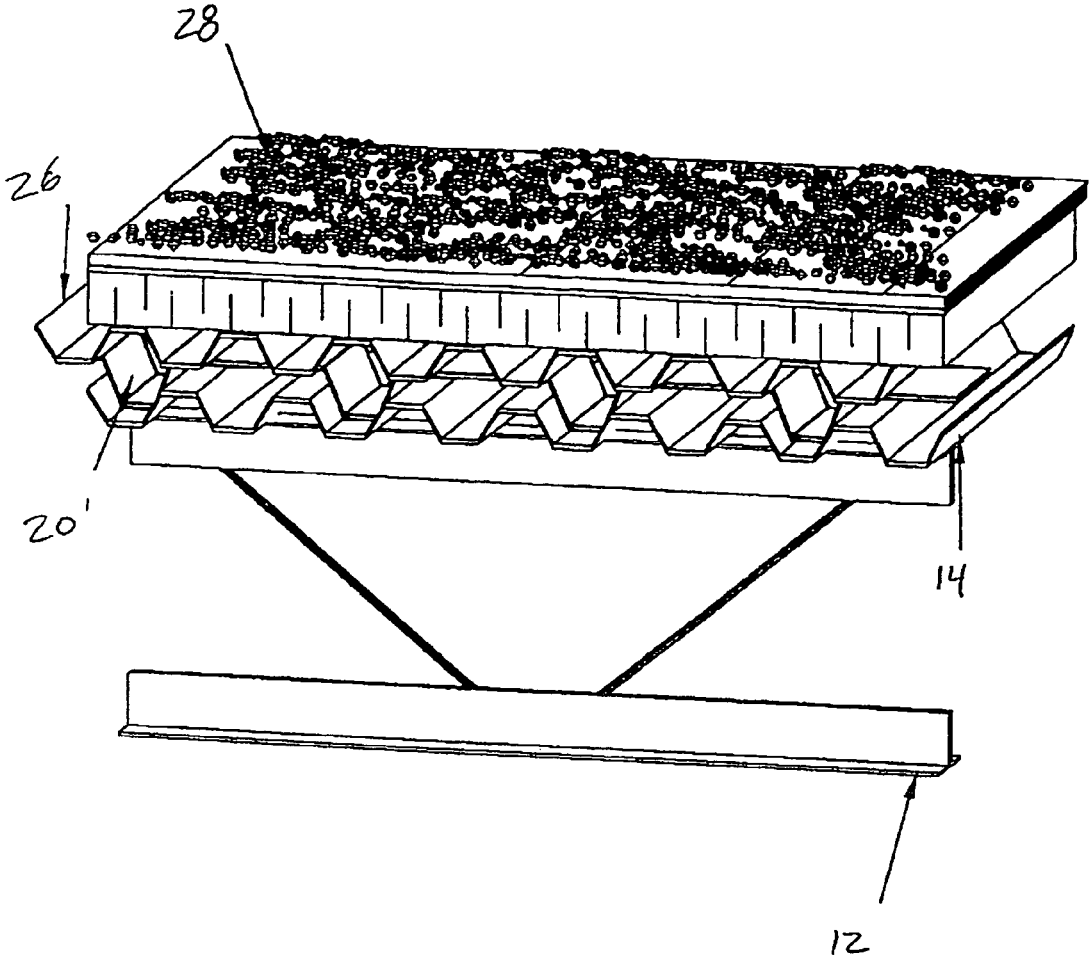
FIG. 9 is a perspective view of the roof with new roofing and insulation installed on the new roof deck.

A new roof deck 26 is attached to the upper portions 24 of the deck straps 20 as shown in FIG. 4. Thereafter a new roof and insulation 28 are attached to the roof deck 26 as shown in FIG. 5.

Referring to FIGS. 6 to 9 an alternate method of re-roofing an existing roof is shown. This method is similar to that described above, but rather than only removing a strip of the existing roof and insulation, all of the existing roof and insulation are removed leaving the open web steel joist 12 and the existing metal deck 14. The remainder of the method is the essentially the same. The deck strap 20' can be modified somewhat since the upper portions 24' need only extend upwardly of the existing metal deck 14 and not the existing roofing and insulation 16 since this has been removed.

As will be appreciated by those skilled in the art the re-roofing system shown herein is a solution whereby the contractor is able to leave the existing damaged deck in place and transfer all structural and fire properties to new decking placed above the existing roofing. The new roof is to be located parallel to and directly over the structural roof joists.

The basic proposed means of application is to remove the existing waterproofing and insulating materials or the existing roofing and insulation materials 16 over the areas of damaged existing decking 14, specifically to expose the locations of the structural roof joists 12. The corrosion protected flat roof lift strap 20 would then be mechanically fastened parallel to the structural roof joist without the removal of the existing decking. A flat roof lift strap 20 would be installed at each structural roof joist 12 located in the affected areas. New steel decking 26 of correct structural requirements is then mechanically fastened to the flat roof lift strap, providing a new structural surface maintaining the structural diaphragm, suitable fire protection of new roofing materials 28 and support surface for new low slope or flat roofing materials.

The two possible variations on the application are to either: remove all materials down to the existing decking for the entire affected area as shown in FIGS. 6 to 9 or remove the materials down to the existing decking at the roof joist locations only for a width of the flat roof lift strap as shown in FIGS. 1 to 5.

In order to provide tie-in to existing roofing materials the perimeter of the raised section is suitably canted and sealed to the existing roof.

The strap 20 is varied in dimensions depending on the particular application and the loads required. Specifically the length of the upper portion 24 may vary from the equivalent of one steel deck flute (150 mm) to multiple flutes (1220 mm) and widths of the strap may vary from 50 mm to 200 mm. The height of the flat roof lift strap between the upper portion 24 and the lower portion 22 is varied from 50 mm overall to 250 mm.

The type sizing and spacing of fasteners for both the flat roof lift strap and the new decking is determined by the loading requirements on a per project basis.

As used herein, the terms "comprises" and "comprising" are to construed as being inclusive and opened rather than exclusive. Specifically, when used in this specification including the claims, the terms "comprises" and "comprising" and variations thereof mean that the specified features, steps or components are included. The terms are not to be interpreted to exclude the presence of other features, steps or components.

It will be appreciated that the above description related to the invention by way of example only. Many variations on the invention will be obvious to those skilled in the art and such obvious variations are within the scope of the invention as described herein whether or not expressly described.

What is claimed as the invention is:

1. A concrete-free roof system for installation on an existing roof having a plurality of open web steel joists with an existing corrugated metal deck thereon, the existing corrugated metal deck having alternating top portions and bottom portions and being part of a structural diaphragm comprising:

a plurality of deck straps mechanically fastened to the open web steel joists through the existing metal deck, each deck strap having a plurality of alternating spaced apart lower portions and a plurality of alternating spaced apart upper portions, the lower portions being integrally formed with the upper portions, the lower portions being attached to the open web steel joists and the upper portions extending upwardly of the existing metal deck, wherein the lower portions are dimensioned to be received within the corrugations of the existing metal deck and the length of each lower portion does not exceed the width of each bottom portion of the existing metal deck and each upper portion spans at least one of the top portion of the existing metal deck and is spaced above the top portion of the existing metal deck;

a roof deck mechanically fastened to and in direct contact with the upper portions of the deck strap and forming part of the structural diaphragm; and roofing and insulation attached to the roof deck.

2. A concrete-free roof system as claimed in claim 1 wherein each deck strap is a continuous deck strap that extends from one side of the roof to the other side of the roof.

3. A concrete-free roof system as claimed in claim 2 wherein the roof is a flat roof.

4. A concrete-free roof system as claimed in claim 2 wherein each strap has a width between 50 mm and 200 mm, a height between the lower portion and the upper portion of between 50 mm and 250 mm and a length of the upper portion between 150 mm to 1220 mm.

5. A concrete-free roof system as claimed in claim 1 wherein the existing roof further includes existing roofing and insulation with strips removed therefrom over the open web steel joists and wherein the plurality of deck straps are installed where the strips of the existing roof have been removed and wherein the upper portions of the deck straps further extend upwardly of the existing roofing and insulation.

6. A concrete-free roof system as claimed in claim 5 wherein each deck strap is a continuous deck strap that extends from one side of the roof to the other side of the roof.

7. A concrete-free roof system as claimed in claim 6 wherein the roof is a flat roof.

8. A concrete-free roof system as claimed in claim 6 wherein each strap has a width between 50 mm and 200 mm, a height between the lower portions and the upper portions of between 50 mm and 250 mm and a length of the upper portions between 150 mm and 1220 mm.

* * * * *